US005551451A

United States Patent [19]

Riggs et al.

[11] Patent Number: 5,551,451

[45] Date of Patent: Sep. 3, 1996

[54] FUEL ELEMENT COMPOSITION

[75] Inventors: Dennis M. Riggs, Belews Creek; Dwayne W. Beeson, Kernersville; Billy T. Conner, Greensboro, all of N.C.

[73] Assignee: R. J. Reynolds Tobacco Company, Winston-Salem, N.C.

[21] Appl. No.: 425,354

[22] Filed: Apr. 19, 1995

Related U.S. Application Data

[63] Continuation of Ser. No. 43,886, Apr. 7, 1993, abandoned.

[51] Int. Cl.[6] ..... A24B 15/00

[52] U.S. Cl. ..... 131/359; 131/194; 44/500; 44/520; 44/522

[58] Field of Search ..... 131/359, 369, 131/194; 44/502, 520, 522, 500

[56] References Cited

U.S. PATENT DOCUMENTS

| | | | |
|---|---|---|---|
| 4,708,151 | 11/1987 | Shelar . | |
| 4,714,082 | 12/1987 | Banerjee et al. . | |
| 4,732,168 | 3/1988 | Resce et al. . | |
| 4,756,318 | 7/1988 | Clearman et al. . | |
| 4,782,644 | 11/1988 | Haarer et al. . | |
| 4,793,365 | 12/1988 | Sensabaugh, Jr. et al. . | |
| 4,802,568 | 2/1989 | Haarer et al. . | |
| 4,807,809 | 2/1989 | Pryor et al. . | |
| 4,827,950 | 5/1989 | Banerjee et al. . | |
| 4,870,748 | 10/1989 | Hensgen et al. . | |
| 4,889,143 | 12/1989 | Pryor et al. . | |
| 4,893,637 | 1/1990 | Hancock et al. . | |
| 4,893,639 | 1/1990 | White . | |
| 4,903,714 | 2/1990 | Barnes et al. . | |
| 4,938,238 | 7/1990 | Barnes et al. . | |
| 4,989,619 | 2/1991 | Clearman et al. . | |
| 5,025,814 | 6/1991 | Raker et al. . | |
| 5,027,837 | 7/1991 | Clearman et al. . | |
| 5,038,802 | 8/1991 | White et al. . | |
| 5,042,509 | 8/1991 | Banerjee et al. . | |
| 5,052,413 | 10/1991 | Baker et al. . | |
| 5,060,666 | 10/1991 | Clearman et al. . | |
| 5,065,776 | 11/1991 | Lawson et al. . | |
| 5,067,499 | 11/1991 | Banerjee et al. . | |
| 5,076,292 | 12/1991 | Sensabaugh, Jr. et al. . | |
| 5,076,297 | 12/1991 | Farrier et al. . | |
| 5,099,861 | 3/1992 | Clearman et al. . | |
| 5,101,839 | 4/1992 | Jakob et al. . | |
| 5,105,831 | 4/1992 | Banerjee et al. . | |
| 5,105,837 | 4/1992 | Barnes et al. . | |
| 5,105,838 | 4/1992 | White et al. . | |
| 5,203,355 | 4/1993 | Clearman et al. | 131/359 |
| 5,247,947 | 9/1993 | Clearman et al. | 131/359 x |

FOREIGN PATENT DOCUMENTS

| | | |
|---|---|---|
| 0339690 | 11/1989 | European Pat. Off. . |
| 0430658A2 | 6/1991 | European Pat. Off. . |
| 0467658A2 | 1/1992 | European Pat. Off. . |
| 0525347A2 | 2/1993 | European Pat. Off. . |

*Primary Examiner*—Jennifer Bahr

[57] ABSTRACT

The present invention is directed to a composition suitable for making fuel elements for smoking articles, which comprises at least about 50 weight percent, preferably at least about 60 weight percent, and most preferably at least about 70 weight percent powdered elemental carbon, preferably carbon obtained from the controlled carbonization of hardwood paper pulp. The fuel composition also comprises at least about 1 weight percent, preferably at least about 5 weight percent, and most preferably at least about 10 weight percent of a suitable binder. The fuel composition of the present invention can include at least about 3 weight percent, preferably at least about 5 weight percent, and most preferably at least about 8 weight percent powdered graphite. Finally, the fuel composition of the present invention can include at least about 1 weight percent, preferably at least about 2 weight percent, and most preferably at least about 3 weight percent of a suitable inorganic filler such as calcium carbonate, or the like. If necessary or desired, other additives can be included in the fuel compositions of the present invention, including up to about 10 weight percent powdered tobacco and/or up to about 1.5 weight percent sodium carbonate; and the like.

18 Claims, 1 Drawing Sheet

FUEL ELEMENT COMPOSITION

This is a continuation of application Ser. No. 08/043,886 filed on Apr. 7, 1993, now abandoned.

FIELD OF THE INVENTION

The present invention is directed to improvements in smoking articles, particularly smoking articles employing tobacco. Cigarettes, cigars and pipes are popular smoking articles which use tobacco in various forms. Many products have been proposed as improvements upon, or alternatives to, the various popular smoking articles. For example, numerous references have proposed articles which generate a flavored vapor and/or a visible aerosol. Most of such articles have employed a combustible fuel source to provide an aerosol and/or to heat an aerosol forming material. See, for example, the background art cited in U.S. Pat. No. 4,714,082 to Banerjee et al.

BACKGROUND OF THE INVENTION

The present invention relates to smoking articles such as cigarettes, and in particular to those smoking articles having a short fuel element and a physically separate aerosol generating means. Smoking articles of this type, as well as materials, methods and/or apparatus useful therein and/or for preparing them, are described in the following U.S. Pat. No. 4,708,151 to Shelar; U.S. Pat. No. 4,714,082 to Banerjee et al.; U.S. Pat. No. 4,732,168 to Resce; U.S. Pat. No. 4,756,318 to Clearman et al.; U.S. Pat. No. 4,782,644 to Haarer et al.; U.S. Pat. No. 4,793,365 to Sensabaugh et al.; U.S. Pat. No. 4,802,568 to Haarer et al.; U.S. Pat. No. 4,827,950 to Banerjee et al.; U.S. Pat. No. 4,870,748 to Hensgen et al.; U.S. Pat. No. 4,881,556 to Clearman et al.; U.S. Pat. No. 4,893,637 to Hancock et al.; U.S. Pat. No. 4,893,639 to White; U.S. Pat. No. 4,903,714 to Barnes et al.; U.S. Pat. No. 4,917128 to Clearman et al.; U.S. Pat. No. 4,928,714 to Shannon; U.S. Pat. No. 4,938,238 to Barnes et al., U.S. Pat. No. 4,989,619 to Clearman et al., U.S. Pat. No. 5,027,837 to Clearman et al., U.S. Pat. No. 5,038,802 to White et al., U.S. Pat. No. 5,042,509 to Banerjee et al., U.S. Pat. No. 5,052,413 to Baker et al., U.S. Pat. No. 5,060,666 to Clearman et al., U.S. Pat. No. 5,065,776 to Lawson et al., U.S. Pat. No. 5,067,499 to Banerjee et al., U.S. Pat. No. 5,076,292 to Sensabaugh et al., U.S. Pat. No. 5,076,297 to Farrier et al., U.S. Pat. No. 5,088,507 to Baker et al., U.S. Pat. No. 5,099,861 to Clearman et al., U.S. Pat. No. 5,101,839 to Jakob et al., U.S. Pat. No. 5,105,831 to Banerjee et al., and U.S. Pat. No. 5,105,837 to Barnes et al., as well as in the monograph entitled *Chemical and Biological Studies of New Cigarette Prototypes That Heat Instead of Burn Tobacco,* R. J. Reynolds Tobacco Company, 1988 (hereinafter "RJR Monograph"). These smoking articles are capable of providing the smoker with the pleasures of smoking (e.g., smoking taste, feel, satisfaction, and the like). Such smoking articles typically provide low yields of visible sidestream smoke as well as low yields of FTC tar when smoked.

The smoking articles described in the aforesaid patents and/or publications generally employ a combustible fuel element for heat generation and an aerosol generating means, positioned physically separate from, and typically in a heat exchange relationship with the fuel element. Many of these aerosol generating means employ a substrate or carrier for one or more aerosol forming materials, e.g., polyhydric alcohols, such as glycerin. The aerosol forming materials are volatilized by the heat from the burning fuel element and upon cooling form an aerosol. Normally, the fuel elements of such smoking articles are circumscribed by an insulating jacket.

The fuel elements employed in the above-described smoking articles burn to produce combustion products such as carbon dioxide, carbon monoxide, water and trace quantities of other compounds. One known method for reducing the amount of carbon monoxide produced by the burning of a fuel element is to reduce the combustion temperature of that fuel element. Reducing the combustion temperature reduces the calories generated, thereby reducing the heat that must be dissipated during smoking.

SUMMARY OF THE INVENTION

The present invention is directed to improvements in fuel element compositions, whereby the carbon monoxide generated during combustion of the fuel element is reduced over previously known fuel compositions, and the fuel composition affords reduced thermal energy output during smoking, particularly during puffing, which in turn, reduces the carbon monoxide (CO) levels produced during the burning of the fuel element and assists in preventing the overheating of the smoking article or components thereof.

The fuel composition of the present invention comprises one or more carbonaceous materials, such as elemental carbon, particularly hardwood paper pulp carbon, combined with additives including graphite, and/or an inorganic filler material such as calcium carbonate, sodium carbonate, and the like. In preferred fuel compositions, the beneficial effects described above have been found to be most dramatic when graphite and/or calcium carbonate are added to the elemental carbon and binder fuel mixture.

In one embodiment of the .present invention, the fuel composition suitable for making fuel elements for smoking articles, comprises at least about 50 weight percent, preferably at least about 60 weight percent, and most preferably at least about 70 weight percent powdered elemental carbon, preferably carbon obtained from the controlled carbonization of hardwood paper pulp. Powdered elemental carbon, as defined and used herein, has an average particle size of less than about 30 microns (μm) in diameter, preferably less than about 20 μm, and most preferably about 12 μm. The particle sizes described here are determined using a Microtrac Analyzer (Leeds & Northrup). The fuel composition also comprises at least about 1 weight percent, preferably at least about 5 weight percent, and most preferably at least about 10 weight percent of a suitable binder.

As described above, the fuel composition of the present invention includes one or more additives such as graphite and/or an inorganic filler material such as calcium carbonate, sodium carbonate, or the like. Thus, the fuel composition described above can further comprise at least about 3 weight percent, preferably at least about 5 weight percent, and most preferably at least about 8 weight percent powdered graphite. Typically, the amount of graphite added to the fuel composition does not exceed about 20 weight percent. However, if desired, higher amounts can be employed. Preferably, the graphite is added in a powdered form, having an average diameter as determined above of less than about 20 μm, preferably less than about 14 μm, and most preferably about 8 μm.

Similarly, the previously described fuel compositions can further comprise at least about 1 weight percent, preferably at least about 2 weight percent, and most preferably at least about 3 weight percent of a suitable inorganic filler such as calcium carbonate, or the like. Typically, the amount of added inorganic filler such as $CaCO_3$ does not exceed about 15 weight percent. However, if desired, higher amounts can be employed.

If necessary or desired, other additives can be included in the fuel compositions of the present invention, including up to about 10 weight percent powdered tobacco, having an average particle size of less than about 20 μm, preferably less than about 15 μm, and most preferably less than about 10 μm; and/or up to about 1.5 weight percent sodium carbonate; and the like.

One particularly preferred class of binder useful herein are the alginate binders, particularly ammonium alginate. In especially preferred embodiments, the powdered elemental (e.g., hardwood pulp) carbon has an average particle size of about 12 μm, and the powdered graphite has an average particle size of about 8 μm.

In general, the fuel elements formed from the compositions of the present invention, which are suitable for use in smoking articles, are up to about 8 mm in diameter and up to about 20 mm in length. These fuel elements are generally formed using conventional extrusion techniques using the present composition and sufficient water to form an extrudable paste.

The present invention is also directed to smoking articles employing the fuel elements formed from the composition of the present invention. Cigarettes are the most popular form of smoking article using the fuel elements of the present inventions, but other smoking articles, e.g., pipes may also be formed. In one preferred embodiment, the present invention provides a cigarette comprising a fuel element less than about 20 mm, preferably less than about 15 mm, and most preferably about 12 mm in length and less than about 8 mm, preferably less than about 6 mm, and most preferably about 4.2 mm in diameter prior to smoking, said fuel element being formed by extruding a fuel composition comprising at least about 50 weight percent powdered hardwood pulp carbon, at least about 1 weight percent ammonium alginate binder, at least about 3 weight percent powdered graphite, and at least about 1 weight percent calcium carbonate; said fuel element having a jacket of resilient insulating material around its circumference; and a physically separate aerosol generating means disposed longitudinally behind said fuel element, said aerosol generating means including a substrate bearing an aerosol forming substance.

As used herein, the term "carbonaceous" means comprising primarily carbon.

DETAILED DESCRIPTION OF PREFERRED EMBODIMENTS

Figure 1:
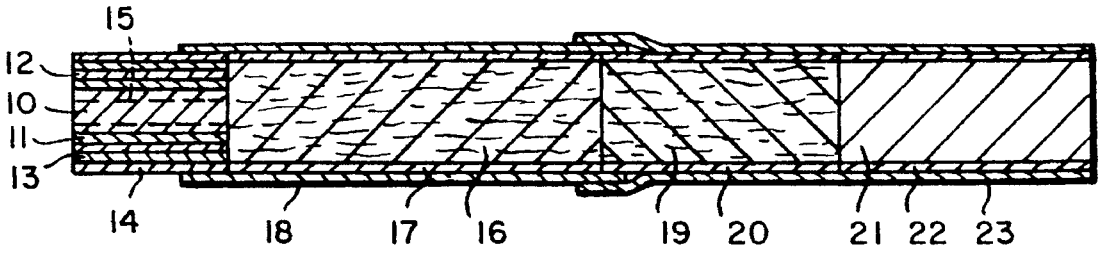
FIG. 1 illustrates in sectional view, one embodiment of a cigarette incorporating a fuel element prepared in accordance with the present invention.
Figure 1A:
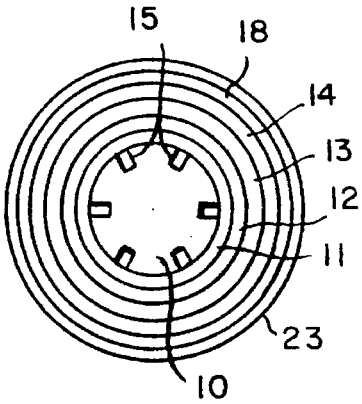
FIG. 1A is an end view of the cigarette shown in FIG. 1.

As described above, the present invention is particularly directed to improvements in carbonaceous fuel elements useful in smoking articles. FIGS. 1 and 1A illustrate a preferred embodiment of a cigarette employing a fuel element of the present invention.

As illustrated in FIG. 1 and more particularly in FIG. 1A, the fuel element 10 includes a number of grooves 15 running along its longitudinal periphery. An insulating jacket surrounds the periphery of the fuel element and in the illustrated embodiment comprises alternating layers of glass fibers and tobacco paper, arranged as concentric rings emanating outwardly from the fuel element in the following order; (a) a first glass fiber mat 11; (b) tobacco paper 12; and (c) a second glass fiber mat 13; and an outer paper wrapper 14. The outer paper wrapper 14 may comprise one layer or may be prepared from a plurality of separate layers, each having different porosity and ash stability characteristics.

Situated behind the insulated fuel element 10, is an aerosol generating means, which includes substrate 16 which contains one or more aerosol forming materials and/or flavorants. In cigarettes of this type, the substrate 16 is advantageously formed from a cast sheet material containing tobacco (in rolled or cut filler form), which is described in greater detail below. Substrate 16 is overwrapped with a paper overwrap 14, which extends over the fuel element 10.

As illustrated, substrate 16 is positioned in a barrier tube 17. The barrier tube can be a laminated material, e.g., a paper and metal (e.g., aluminum) foil laminate, advantageously with the foil on the inside, or a similar structure which will assist in reducing or eliminating any migration of the aerosol former from the substrate 16 to other components of the cigarette. If desired, one or more void spaces (not shown) may be formed using barrier tube 17 to isolate the substrate 16 from the other components of the cigarette.

Spaced longitudinally behind the barrier tube 17 is a segment of reconstituted tobacco 19, overwrapped with cigarette paper 20. The reconstituted tobacco segment is typically provided in cut filler form, and it is used to provide tobacco flavors to the aerosol emitted from the aerosol generating means. Tobacco segment 19 can be omitted if desired and a void space or other material substituted therefor. Alternatively, the substrate 16 can be lengthened and the reconstituted tobacco segment 19 shortened or omitted. If desired, a tobacco paper section (not shown), circumscribed by a paper wrapper, can be included between substrate 16 and the tobacco segment 19, or added behind tobacco segment 19. If desired, a carbon filled sheet containing a flavorant such as menthol can used in conjunction with the reconstituted tobacco segment 19 or be substituted for the tobacco paper section.

Positioned at the extreme mouth end of the cigarette is a low-efficiency filter element 21, overwrapped with paper 22. A tipping paper 23 is used to join the filter 21 to the tobacco cut filler segment of the cigarette. If desired, the tobacco cut filler segment 19 can be omitted and an extra long filter would preferably be employed.

Circumscribing the insulated fuel element, at a point about 2 to 8 mm from the lighting end of the cigarette, and combining it with the combined barrier tube 17 is a non-burning paper wrapper 18. Wrapper 18 is preferably a non-wicking material comprising three laminated layers, e.g., paper—aluminum foil—paper, which aids in minimizing any transfer of the aerosol forming materials on the substrate 16 to the fuel element 10, the insulating jacket, and/or potential staining of the other components of the front end assembly. This wrapper also preferably minimizes or prevents peripheral air (i.e., radial air) from flowing to the portion of the fuel element disposed longitudinally behind its forward edge, thereby causing oxygen deprivation and preventing excessive combustion.

Figure 2:
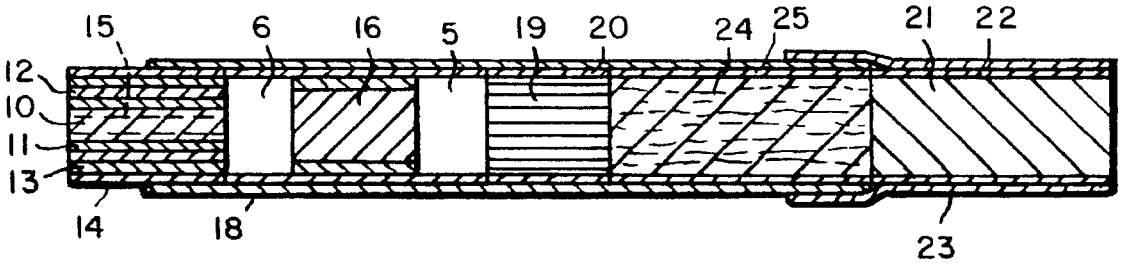
FIG. 2 illustrates in sectional view, another embodiment of a cigarette incorporating a fuel element prepared in accordance with the present invention.

As in the FIG. 1 cigarette, the embodiment illustrated in FIG. 2, has a fuel element 10, which includes a number of grooves 15 running along its longitudinal periphery. Again, an insulating jacket surrounds the periphery of the fuel element and in the illustrated embodiment comprises alternating layers of glass fibers and tobacco paper, arranged as concentric rings emanating outwardly from the fuel element in the following order; (a) a first glass fiber mat 11; (b) tobacco paper 12; and (c) a second glass fiber mat 13; and an outer paper wrapper 14. The outer paper wrapper 14 may comprise one layer or may be prepared from a plurality of separate layers, each having different porosity and ash stability characteristics.

In FIG. 2, the aerosol generating means, which includes substrate 16 which contains one or more aerosol forming materials and/or flavorants is situated behind and spaced slightly apart from the insulated fuel element 10. This placement assists in preventing migration of the aerosol forming materials from the substrate to other components of the cigarette. Substrate 16 is overwrapped with a paper overwrap 17 which advantageously may be treated (e.g., coated) with a barrier material to reduce or preferably prevent any migration of the aerosol forming materials from the substrate to other parts of the cigarette.

In cigarettes of this type, the substrate 16 may be any one of a number of materials, including a plug of heat-stabilized paper, e.g., paper treated with one or more hydrated salts; or a plug formed from a cast sheet material containing tobacco (in rolled or cut filler form), both of which are described in greater detail below.

As illustrated substrate 16 is positioned in a barrier tube 17 so that void spaces 5 and 6 are provided at each end of the substrate plug. The barrier tube can be a laminated paper or any similar structure which will assist in reducing or eliminating any migration of the aerosol former from the substrate 16 to other components of the cigarette.

Spaced longitudinally behind the barrier tube 17 is a segment of reconstituted tobacco paper 19, overwrapped with cigarette paper 20. This tobacco paper segment is used to provide tobacco flavors to the aerosol emitted from the aerosol generating means. Tobacco paper segment 19 can be omitted if desired and a void space or other material substituted therefor. Alternatively, the substrate 16 can be lengthened and the tobacco paper shortened or omitted.

Longitudinally disposed behind the tobacco paper segment is a tobacco cut filler section 24, circumscribed by a paper wrapper 25. This segment adds additional tobacco flavors to the aerosol passing through. If desired, the tobacco cut filler section can be omitted and either an extra long filter segment 21 used, and/or, if desired, a carbon filled sheet containing a flavorant such as menthol can be substituted for or used in conjunction with the tobacco paper segment 19.

Positioned at the extreme mouth end of the cigarette is a low-efficiency filter element 21, overwrapped with paper 22. A tipping paper 23 is used to join the filter 21 to the tobacco cut filler segment of the cigarette.

Circumscribing the insulated fuel element, at a point about 2 to 8 mm from the lighting end of the cigarette, and combining it with the combined barrier tube 17 is a non-burning paper wrapper 18. Wrapper 18 is preferably a non-wicking material comprising three laminated layers, e.g., paper—aluminum foil—paper, which prevents transfer of the aerosol forming materials on the substrate 16 to the fuel element 10, the insulating jacket, and/or from staining of the other components of the front end assembly. This wrapper also preferably minimizes or prevents peripheral air (i.e., radial air) from flowing to the portion of the fuel element disposed longitudinally behind its forward edge, thereby causing oxygen deprivation and preventing excessive combustion.

In another preferred embodiment, the jacketed fuel element is shortened so that only the required amount of burnable carbonaceous material is provided for the generation of a predetermined number of puffs. In such an embodiment, the outer wrapper 18 preferably extends to the forward end of the jacketed fuel element. This wrapper must then be provided with an appropriate level of porosity to permit the fuel to obtain the air needed for burning, while having sufficient cohesiveness during and after burning to remain intact, to hold the jacketed fuel element on the cigarette. Such papers are described in U.S. Pat. No. 4,938,238.

The fuel elements employed herein should meet three criteria; (1) they should be easy to ignite, (2) they should supply enough heat to produce aerosol for about 5–15, preferably about 8–12 puffs; and (3) they should not contribute off-taste or unpleasant aromas to the cigarette.

As described above, one fuel composition considered for the present invention comprises from about 50 to about 80 weight percent powdered elemental carbon, preferably e.g., hardwood pulp carbon, from about 5 to about 10 weight percent of a binder, and powdered graphite added at levels ranging from 5 to 15 weight percent. Other components of the fuel composition include tobacco at from about 5 to 10 weight percent, sodium carbonate, at less than about 2 weight percent, preferably at less than about 1 weight percent, and flavors at less than about 2 weight percent, preferably at from about 0.5 to about 1.5 weight percent.

Studying the effect of variation of the graphite levels in fuel compositions revealed the following; as the graphite level increased, the carbon monoxide levels obtained by burning from about 6 to 8 mm of a fuel element having a 12 mm length and a 4.2 mm diameter, and measuring CO output using FTC smoking conditions, fell to as low as 3.0 mg and the thermal energy output of the fuel elements also decreased significantly.

In some of the smoking articles examined employing the fuel elements of the present invention, the substrate comprises paper. Such substrates are described in detail in copending application Ser. No. 07/882,209, filed 13 May 1992. The graphite related reduction in thermal output of burning fuel elements is particularly beneficial when paper substrates are employed, since this reduction also reduces the tendency of the paper substrate to be scorched during smoking, thereby eliminating off-tastes.

In some of the test smoking articles employing the fuel elements of the present invention, a foil backed paper was used as part of the outer wrapper over the rear periphery of the fuel element. In such cigarettes, the addition of graphite to the fuel composition also resulted in a larger "stub" remaining under the foil paper when the fuel was extinguished. This is a very desirable result, particularly from a fuel retention standpoint.

The only negative attribute associated with the addition of graphite to the fuel composition was the fact that the addition of the graphite had a tendency to make the fuel element more difficult to ignite. The more graphite that was added, the more difficult the fuel element was to light. While the fuel elements which included graphite as described above could be ignited, it was believed that the use of graphite alone did not provide an entirely suitable product.

Thus, further analysis was conducted using calcium carbonate as an additive to the basis composition described above, at from about 5 percent to about 15 weight percent, first without the addition of any graphite. Basic fuel compositions including such added calcium carbonate also showed reductions in both CO and thermal energy outputs. However, it was found that a significantly higher level of calcium carbonate was required to produce the same effect that a lesser amount of graphite produced.

More importantly, it was found that the addition of calcium carbonate to the fuel composition (1) did not adversely affect the lighting characteristics of the fuel element and (2) during burning, the calcium carbonate in the fuel element reacted with the insulating jacket which surrounded the fuel in the test cigarettes, forming a fused link between the jacket and the fuel element, thereby providing excellent fuel retention qualities to the cigarette during smoking.

Based on the independent beneficial effects of graphite and calcium carbonate as described above, it was decided that these two additives should be combined in the fuel composition, with the goal of obtaining the beneficial attributes of each, with the elimination of any detrimental effects.

Thus the most preferred fuel composition of the present invention was developed, which comprises powdered hardwood pulp carbon, powdered graphite, calcium carbonate, tobacco and a binder. When burned in test cigarettes, fuel elements prepared from this composition showed significant reductions in both CO generation and thermal energy outputs, yet they had better lighting characteristics and fuel retention characteristics, than cigarettes prepared with fuel elements made from a composition containing just the graphite additive alone.

Thus, in one especially preferred embodiment of the present invention, the fuel composition comprises the following (by weight):

10% ammonium alginate binder
8.4% graphite (approx. 8 μm particle size)
3.0% calcium carbonate powder
1.0% sodium carbonate
5.0% tobacco
72.6% hardwood pulp carbon (approx. 12 μm particle size)

The preferred fuel elements formed from the composition of the present invention are designed to decrease the energy available to produce a desired amount of aerosol, thereby improving the efficiency of the fuel element and reducing the amount of excess thermal energy which otherwise would have to be dissipated from the cigarette. Thus, the fuel elements of the present invention provide a more efficient energy source for the cigarettes in which they are employed.

The density of the preferred fuel elements is generally greater than about 0.5 g/cc, preferably greater than about 0.7 g/cc and most preferably greater than about 1 g/cc, but typically does not exceed 2 g/cc.

The overall length of the fuel element, prior to burning, is generally less than about 20 mm, often less than about 15 mm, and is typically about 12 mm. However, shorter fuel elements may be used if desired, depending upon the configuration of the cigarette in which they are employed. The overall outside diameter of the fuel element is typically less than about 8 mm, advantageously less than about 6 mm and is preferably about 4.2 mm.

The carbonaceous and binder portions of the fuel compositions useful herein may be any of those carbonaceous and binder materials described in the patents recited in the Background of the Invention, supra. Preferred carbonaceous and binder materials are described in copending application Ser. No. 07/722,993, filed 28 Jun. 1991, now U.S. Pat. No. 5,178,167 the disclosure of which is hereby incorporated herein by reference.

When employed in a cigarette, the fuel element is advantageously circumscribed by an insulating and/or retaining jacket material. The insulating and retaining material preferably (i) is adapted such that drawn air can pass therethrough, and (ii) is positioned and configured so as to hold the fuel element in place. Preferably, the jacket is flush with the ends of the fuel element, however, it may extend from about 0.5 mm to about 3 mm beyond each end of the fuel element.

The components of the insulating and/or retaining material which surrounds the fuel element can vary. Examples of suitable materials include glass fibers and other materials as described in U.S. Pat. No. 5,105,838; European Patent Publication No. 339,690; and pages 48–52 of the RJR Monograph, supra. Examples of other suitable insulating and/or retaining materials are glass fiber and tobacco mixtures such as those described in U.S. Pat. Nos. 5,105,838, 5,065,776 and 4,756,318; and U.S. patent application Ser. No. 07/354,605, filed 22 May 1989 now U.S. Pat. No. 5,119,837.

Other suitable insulating and/or retaining materials are gathered paper-type materials which are spirally wrapped or otherwise wound around the fuel element, such as those described in U.S. patent application Ser. No. 07/567,520, filed 15 Aug. 1990, now U.S. Pat. No. 5,105,836. The paper-type materials can be gathered or crimped and gathered around the fuel element; gathered into a rod using a rod making unit available as CU-10 or CU2OS from DeCoufle s.a.r.b., together with a KDF-2 rod making apparatus from Hauni-Werke Korber & Co., KG, or the apparatus described in U.S. Pat. No. 4,807,809 to Pryor et al.; wound around the fuel element about its longitudinal axis; or provided as longitudinally extending strands of paper-type sheet using the types of apparatus described in U.S. Pat. No. 4,889,143 to Pryor et al. and U.S. Pat. No. 5,025,814 to Raker, the disclosures of which are incorporated herein by reference.

If desired, the fuel element 10 may be extruded into the insulating jacket material as set forth in U.S. patent application Ser. No. 07/856,239, filed 25 Mar. 1992, the disclosure of which is incorporated herein by reference.

Examples of paper-type sheet materials are available as P-2540-136-E carbon paper and P-2674-157 tobacco paper from Kimberly-Clark Corp.; and preferably the longitudinally extending strands of such materials (e.g., strands of about 1/32 inch width) extend along the longitude of the fuel element. The fuel element also can be circumscribed by tobacco cut filler (e.g., flue-cured tobacco cut filler treated with about 2 weight percent potassium carbonate). The number and positioning of the strands or the pattern of the gathered paper is sufficiently tight to maintain, retain or otherwise hold the composite fuel element structure within the cigarette.

As illustrated in FIGS. 1 & 1A, the insulating jacket which surrounds the fuel element is circumscribed by a paper wrapper. Suitable papers for use herein are described in U.S. Pat. No. 4,938,238 and U.S. patent application Ser. No. 07/574,327, filed 28 Aug. 1990 U.S. Pat. No. 5,105,837.

As described above, the substrate carries aerosol forming materials and other ingredients, e.g., flavorants and the like, which, upon exposure to heated gases passing through the aerosol generating means during puffing, are vaporized and delivered to the user as a smoke-like aerosol. Preferred aerosol forming materials used herein include glycerin, propylene glycol, water, and the like, flavorants, and other optional ingredients. The patents referred to in the Background of the Invention (supra) teach additional useful aerosol forming materials that need not be repeated here.

As described above, the substrate may have various forms, particularly as set forth in the patents cited in the Background of the Invention, supra. Two preferred substrates for use herein are (a) paper substrates and (b) cast sheet binder/tobacco substrates.

Paper substrate rods are advantageously formed using commercially available equipment, particularly cigarette filter making equipment, or cigarette rod forming equipment. Two preferred commercially available apparatus useful in forming the substrates of the present invention are the DeCoufle filter making equipment (CU-10 or CU2OS) available from DeCoufle s.a.r.b. and a modified rod forming apparatus, the KDF-2, available from Haunie-Werke Korber & Co., KG.

Cast sheets of tobacco dust or powder, a binder, such as an alginate binder, and glycerin can also be used to form useful substrates herein. Suitable cast sheet materials for use as substrates are described in U.S. Pat. No. 5,101,839 and U.S. patent application Ser. No. 07/800,679, filed Nov. 27, 1991.

Suitable cast sheet materials typically contain between about 30 to 75 weight percent of an aerosol former such as glycerin; about 2 to 15 weight percent of a binder, preferably ammonium alginate; 0 to about 2 weight percent of a sequestering agent such as potassium carbonate; about 15 to about 70 to 75 weight percent of organic, inorganic filler materials, or mixtures thereof, such as tobacco dust, aqueous extracted tobacco powder, starch powder, rice flower, ground puffed tobaccos, carbon powder, calcium carbonate powder, and the like, and from about 0 to about 20 weight percent of flavors such as tobacco extracts, and the like.

One especially preferred cast sheet material includes 60 weight percent glycerin, 5 weight percent ammonium alginate binder, 1 weight percent potassium carbonate, 2 weight percent flavors such as tobacco extracts and 32 weight percent aqueous extracted tobacco powder.

The cast sheets are formed by mixing aqueous extracted tobacco powder, water and the potassium carbonate in a high sheer mixer to produce a smooth, flowable paste. Glycerin and ammonium alginate are then added and the high shear mixing is continued until a homogenized mixture is produced. The homogenized mixture is cast on a heated belt (about 200° F.) with a 0.0025 to 0.0035 inch casting clearance and is dried to yield a 0.0004 to 0.0008 inch thick sheet under high temperature air (about 200° to 250° F.). The sheet is doctored from the belt and either wound onto spools for slitting into webs or chopped into rectangular pieces about 2 inches by 1 inch which are formed into cut filler. If the cast sheet material is used in a web or cut filler form, normally the substrate will be from about 10 mm to 40 mm in length and extend from the rear end of the fuel element to the tobacco segment or the front end of an extra long filter segment (e.g., about 30 mm to 50 mm in length). In such instances the tobacco paper plug can be omitted.

In most embodiments of the present invention, the combination of the fuel element and the substrate (also known as the front end assembly) is attached to a mouthend piece; although a disposable fuel element/substrate combination can be employed with a separate mouthend piece, such as a reusable cigarette holder. The mouthend piece provides a passageway which channels vaporized aerosol forming materials into the mouth of the smoker; and can also provide further flavor to the vaporized aerosol forming materials. Typically, the length of the mouthend piece ranges from 40 mm to about 85 mm.

Flavor segments (i.e., segments of gathered tobacco paper, tobacco cut filler, or the like) can be incorporated in the mouthend piece or the substrate segment, e.g., either directly behind the substrate or spaced apart therefrom, to contribute flavors to the aerosol. Gathered carbon paper can be incorporated, particularly in order to introduce menthol flavor to the aerosol. Such papers are described in European Patent Publication No. 342,538. Other flavor segments useful herein are described in U.S. patent application Ser. Nos. 07/414,835, filed 29 Sep. 1989, now U.S. Pat. No. 5,076,295 07/606,287, filed 6 Nov. 1990; now U.S. Pat. No. 5,105,834 and 07/621,499, filed 7 Dec. 1990, now abandoned.

The present invention will be further illustrated with reference to the following examples which aid in the understanding of the present invention, but which are not to be construed as limitations thereof. All percentages reported herein, unless otherwise specified, are weight percent. All temperatures are expressed in degrees Celsius.

EXAMPLE 1

Reference Fuel Element

Reference fuel elements, i.e., non-composite fuel elements, are prepared as follows:

A first fuel element 12 mm long and 4.2 mm in diameter, and having an apparent (bulk) density of about 1.02 g/cc is prepared from about 82.85 parts hardwood pulp carbon having an average particle size of 12 μm in diameter, 10 parts ammonium alginate (Amoloid HV, Kelco Co.), 0.9 parts $Na_2CO_3$, 0.75 parts levulinic acid, 5 parts, ball-milled American blend tobacco and 0.5 parts tobacco extract, obtained as described in U.S. patent application Ser. No. 07/710,273, filed 4 Jun. 1991, now U.S. Pat. No. 5,159,942.

A second fuel element 12 mm long and 4.2 mm in diameter and having an apparent (bulk) density of about 1.02 g/cc is prepared from about 83.55 parts hardwood pulp carbon having an average particle size of 12 μm in diameter, 10 parts ammonium alginate (Amoloid HV, Kelco Co.), 0.2 parts $Na_2CO_3$, 0.75 parts levulinic acid, 5 parts ball milled American tobacco blend and 0.5 parts tobacco extract as obtained and described in U.S. patent application Ser. No. 07/710,273, filed 4 Jun. 1991 now U.S. Pat. No. 5,159,942.

The hardwood pulp carbon is prepared by carbonizing a non-talc containing grade of Grande Prairie Canadian kraft hardwood paper in an inert atmosphere, increasing the temperature in a step-wise manner sufficient to minimize oxidation of the paper, to a final carbonizing temperature of at least 750° C. The resulting carbon material is cooled in the inert atmosphere to less than 35° C., and then ground to fine power having an average particle size (as determined using a Microtrac Analyzer, Leeds & Northrup) of about 12 <m in diameter.

The finely powdered hardwood carbon is dry mixed with the ammonium alginate binder, levulinic acid and the tobaccos, and then a 3 weight percent aqueous solution of $Na_2CO_3$ is added to provide an extrudable mixture, having a final sodium carbonate level of about 0.9 parts.

Fuel rods (each about 24 inches long) are extruded using a screw extruder from the mixture having a generally cylindrical shape about 4.5 mm in diameter, with six (6) equally spaced peripheral grooves (about 0.5 mm wide and about 1 mm deep) with rounded bottoms, running from end to end. The extruded rods have an initial moisture level ranging from about 32–34 weight percent. They are dried at ambient temperature for about 16 hours and the final moisture content is about 7–8 weight percent. The dried cylindrical rods are cut to a length of 12 mm using diamond tipped steel cutting wheels.

EXAMPLE 2

Fuel elements are formed as in Example 1 having the following composition; 75.15 parts elemental carbon (hardwood), 8.4 parts graphite (Aldrich Chemical Co.), 10 parts ammonium alginate, 0.2 parts sodium carbonate, 5 parts tobacco and 1.25 parts flavor.

EXAMPLE 3

Fuel elements are formed as in Example 1 having the following composition; 75.15 parts elemental carbon (hardwood), 8.4 parts calcium carbonate, 10 parts ammonium alginate, 0.2 parts sodium carbonate, 5 parts tobacco and 1.25 parts flavor.

EXAMPLE 4

Fuel elements are formed as in Example 1 having the following composition; 72.15 parts elemental carbon (hardwood), 8.4 parts graphite (Aldrich), 10 parts ammonium alginate, 3.0 parts calcium carbonate, 0.2 parts sodium carbonate, 5 parts tobacco and 1.25 parts flavor.

EXAMPLE 5

Fuel elements are formed as in Example 1 having the following composition; 71.45 parts elemental carbon (hardwood), 8.4 parts graphite (Aldrich), 10 parts ammonium alginate, 3.0 parts calcium carbonate, 0.9 parts sodium carbonate, 5 parts tobacco and 1.25 parts flavor.

EXAMPLE 6

Burn Characteristics

Burning characteristics of fuel elements are determined by using a Beckman Industrial Model 880 NDIR available from the Rosemount Analytical Co. of LaHaber, Calif. in conjunction with a Phoenix Precision Instruments Model JM-6500 aerosol spectrometer, available from the Virtis Company, Gardiner, N.Y., modified as described in copending application Ser. No. 07/882,209, filed May 13, 1992, the disclosure of which is hereby incorporated herein by reference.

The combination of the NDIR and the modified JM-6500 instruments provide means for measuring total carbon dioxide, total carbon monoxide, and total calories generated during the burning of the fuel elements. The instruments also provide a puff-by-puff analysis of those data.

For each example, five fuel elements are jacketed and smoked using the combined instruments for 20 puffs under 50/30 smoking conditions. These conditions consist of a 50 ml puff volume of two seconds duration, separated by 28 seconds of smolder time. Lighting of the fuel elements was by application of a standard lighter flame to the face of the fuel elements for five seconds duration before drawing the first puff under 50/30 smoking conditions.

The results obtained for the reference fuel element of Example 1 are as follows:

| | 0.9 $Na_2CO_3$ | 0.2 $Na_2CO_3$ |
|---|---|---|
| Average Total $CO_2$ | 87 mg | 90.09 mg |
| Average Total CO | 22 mg | 24.31 mg |
| Average Total Calories | 209 | 216 |

-continued

| | 0.9 $Na_2CO_3$ | 0.2 $Na_2CO_3$ |
|---|---|---|
| Average CO/Calorie | 0.105 | 0.113 |

The results obtained for the fuel element of Example 2 are as follows:

| | |
|---|---|
| Average Total $CO_2$ | 69.20 mg |
| Average Total CO | 13.35 mg |
| Average Total Calories | 160 |
| Average CO/Calorie | 0.083 |

The results obtained for the fuel element of Example 3 are as follows:

| | |
|---|---|
| Average Total $CO_2$ | 75.54 mg |
| Average Total CO | 17.94 mg |
| Average Total Calories | 184.13 |
| Average CO/Calorie | 0.096 |

The results obtained for the fuel element of Example 4 are as follows:

| | |
|---|---|
| Average Total $CO_2$ | 76.03 mg |
| Average Total CO | 15.77 mg |
| Average Total Calories | 177.58 |
| Average CO/Calories | 0.089 |

The results obtained for the fuel element of Example 5 are as follows:

| | |
|---|---|
| Average Total $CO_2$ | 77.27 mg |
| Average Total CO | 15.21 mg |
| Average Total Calories | 179.70 |
| Average CO/Calories | 0.085 |

EXAMPLE 7

Cigarette of FIG. 2

Fuel Element

A fuel element prepared as in Example 2, 3, 4 or 5 is employed. The length of the fuel element is 12 mm and the diameter is 4.2 mm.

Insulating Jacket

A 12 mm long, 4.2 mm diameter plastic tube is overwrapped with an insulating jacket material that is also 12 mm in length. In these cigarette embodiments, the insulating jacket is composed of 2 layers of Owens-Corning C-glass mat, each about 1 mm thick prior to being compressed by a jacket forming machine (e.g., such as that described in U.S. Pat. No. 4,893,637), and after formation, each being about 0.6 mm thick. Sandwiched between the two layers of C-glass is one sheet of reconstituted tobacco paper, Kimberly-Clark's P-2831-189-AA. A cigarette paper, designated P-3122-153 from Kimberly-Clark, overwraps the outer layer. The reconstituted tobacco paper sheet is a paper-like sheet made from tobacco, additionally containing a blended tobacco extract. The width of the reconstituted tobacco sheets prior to forming are 19 mm for the inner sheet and 26.5 mm for the outer sheet. The final diameter of the jacketed plastic tube is about 7.5 min.

Substrate

A continuous substrate rod about 7.5 mm in diameter is formed from a highly embossed, 36 g/m$^2$, 152 mm wide web of paper containing 25 weight percent calcium sulfate available from Kimberly-Clark as P3284-19, e.g., on a modified KDF-2 rod forming apparatus. The substrate rod is overwrapped with a paper/aluminum foil laminate having a width of about 24.5 mm, the foil being cast aluminum, 0.0005 inches thick, and the paper is a Simpson Paper Company product known as RJR-002A paper. The laminate is formed with a commercial adhesive, Airflex 465. The laminated paper is formed into a tube (with the foil on the inside) by lap joining using a water based ethylene vinyl acetate adhesive. The overwrapped rod is cut into 31 mm segments in length, and charged with an aerosol former, e.g., glycerin, propylene glycol, and/or flavorants.

Tobacco Paper Plug

A tobacco paper rod about 7.5 mm in diameter is formed from a medium embossed, 127 mm wide web of tobacco paper designated as P-144-GNA-CB available from Kimberly-Clark, e.g., using a rod forming apparatus such as that disclosed in U.S. Pat. No. 4,807,809. The rod is overwrapped with a 26.5 mm wide paper P1487-184-2 from Kimberly-Clark and cut into 10 mm lengths.

Front End Overwrap

A front end overwrap paper is formed by laminating several papers including; an outer layer of Ecusta 456 paper, an intermediate layer of 0.0005 inch thick aluminum foil and an inner layer of tissue paper, 12.5 lbs/ream, 20.4 g/m$^2$. The laminated layers are held together with a commercial adhesive, Airflex 465, using 1.5 lbs/ream.

Aerosol Tube

A paper aerosol tube about 7.5 mm diameter is made from a web of 112 gm basis weight Simpson RJR-002A paper, about 27 mm wide, having a thickness of about 0.012 inch. The RJR-002A paper is formed into a tube by lap-joining the paper using a water-based ethylene vinyl acetate adhesive. The inner and outer surface of the paper tube is coated with a Hercon-70. The paper is cut into segments 31 mm in length Mouth End Tube A paper mouth end tube about 7.5 mm diameter is formed from Simpson Paper, Type RJR 002A, lap joined using a hot-melt adhesive No. 448-195K, available from the R.J. Reynolds Tobacco Company. The formed tube is cut into 40 mm length segments.

Filter Plug

A polypropylene filter rod about 7.5 mm in diameter is formed from a PP-100 mat, about 260 mm wide, available from Kimberly-Clark and overwrapped with a 26.5 mm wide web of paper P1487-184-2, available from Kimberly-Clark, e.g., using the apparatus described in U.S. Pat. No. 4,807,809. The overwrapped rod is cut into 20 mm length segments.

Tobacco Roll

A reconstituted tobacco cut filler prepared as described in U.S. patent application Ser. No. 07/710,273 filed Jun. 14, 1991, is formed into a rod about 7.5 mm in diameter and overwrapped with paper. The overwrapped tobacco roll is cut into 20 mm lengths.

Assembly of Cigarette

A. Front End Piece Assembly

A 10 mm long substrate piece is inserted into one end of the 31 mm long aerosol tube and spaced about 5 mm from the end, thereby forming a void space of about 5 mm. Approximately 150 mg of a mixture comprising glycerin, tobacco extract and other flavors is applied to the substrate. A 10 mm long tobacco paper plug is inserted into the other end of the aerosol tube until the mouth end of the tobacco paper plug is flush with the mouth end of the aerosol tube.

A 12 mm long insulating jacket piece is aligned with the front end of the aerosol tube so that the insulating jacket piece is adjacent the void space in the aerosol tube. The insulating jacket piece and the aerosol tube are circumscribed with a piece of front end overwrap paper, approximately 26.5 mm×37 mm. The tissue paper side of the overwrap paper (supra) is placed toward the aerosol tube and a seam adhesive (2128-69-1) available from the H.B. Fuller Co., Minneapolis, Minn., is used to seal the overlap joint. The 37 mm length of the overwrap is aligned in the longitudinal direction so that the overwrap paper extends from the free end of the aerosol tube to approximately 6 mm over the insulating jacket, leaving approximately 6 mm of the insulating jacket exposed.

The plastic tube in the insulating jacket piece is removed and a 12 mm long fuel element is inserted so that the end of the fuel element is flush with the end of the insulating jacket.

B. Mouthend Piece Assembly

A 20 mm filter plug is inserted into one end of the mouthend tube and a 20 mm tobacco roll inserted into the other end of the mouthend tube so that the plug and roll are flush with the ends of the mouthend tube.

The mouthend piece assembly and the front end piece assembly are aligned so that the tobacco roll abuts the tobacco paper plug and are secured together by a piece of tape to form a cigarette.

The cigarette is smoked, and yields visible aerosol and tobacco flavor (i.e., volatilized tobacco components) on all puffs for about 10–12 puffs. The fuel element burns to about 6 mm back, i.e., to about the region where the foil lined tube overwraps the fuel element, and there the cigarette self-extinguishes.

EXAMPLE 8

Preparation of Components

Jacketed Fuel Rod

A jacketed fuel rod approximately 7.5 mm in diameter, including a fuel element prepared according to any of Examples 2, 3, or 4, and an insulating material is prepared by directly extruding the carbonaceous fuel rod into a multilayer glass fiber/tobacco paper ribbon in accordance with the process described in U.S. patent application Ser. No. 07/856,239, filed 25 Mar., 1992. The jacketed fuel rod is cut into lengths of about 72 min.

Jacket Material

The jacket material is composed of 2 layers of Owens-Corning C-glass mat, each about 1 mm thick prior to being compressed by a jacket forming machine, and after formulation, each being about 0.6 mm thick. Sandwiched between the two layers of C-glass is one or two sheets of reconstituted tobacco paper, Kimberly-Clark's P-3510-96-2. A cigarette paper, designated P-3122-153 from Kimberly-Clark, overwraps the outer layer. The reconstituted tobacco paper sheet, is a paper-like sheet containing a blended tobacco extract. The width of the reconstituted tobacco sheets prior to forming is about 17 mm, while the width of the cigarette paper outer sheet is about 25.5 mm. The seam adhesive used for the outer wrap can be a cold seam adhesive CS 1242, available from RJR Packaging, R.J. Reynolds, Winston-Salem, N.C.

Substrate Tube

A continuous substrate rod about 7.5 mm in diameter is formed from a wide, highly embossed, 36 g, about 7 inch wide web of paper containing 25 weight percent calcium sulfate available from Kimberly-Clark (KC) as P3284-19, e.g., on a modified KDF-2 rod forming apparatus. The substrate rod is overwrapped with a paper/aluminum foil laminate having a width of about 24.5 mm, the foil being a continuous cast 0.0005 inch thick aluminum, and the paper being a Simpson Paper Co. ("Simpson") RJR 002A paper. The lamination adhesive is a silicate adhesive, No. 06-50-05-0051, available from RJR Packaging. A center line adhesive, cold adhesive CS 1242M, available from RJR Packaging, is spray applied to the laminate, to hold the substrate in place within the wrap. The seam is sealed with hot melt adhesive 444-227, from RJR packaging.

The overwrapped rod is cut into 60 mm segments. Approximately 900 mg of an aerosol forming material comprising glycerine, propylene glycol, and flavorants, such as tobacco extract, is applied to the web during formation of the continuous substrate rod. The substrate segment is cut into substrate plugs about 10 mm in length and overwrapped with a Simpson RJR 002A 0.0005 inch thick aluminum foil laminate described above, having a width of about 25.5 mm. The plugs are placed at alternate intervals of 10 and 12 mm along the tube. The plugs are adhered to the tube by corresponding application of hotmelt adhesive No. 448-37A, RJR Packaging. The seam is sealed with hot melt adhesive 444-227, from RJR packaging. Prior to sealing the tube, one longitudinal indentation is made in the substrate plug to space the plug from the seam connection which assists in reducing migration of the aerosol former to other components of the cigarette.

The continuous tube is cut into substrate void tube sections about 42 mm in length having a center void about 12 mm, two substrate plugs 10 mm wide, and void space at each end of about 5 mm in width.

Tobacco Section

A reconstituted tobacco cut filler prepared as described in U.S. patent application No. 07/710,273 filed Jun. 14, 1991, is formed into a rod about 7.5 mm in diameter and overwrapped with paper, e.g. Kimberly Clark 646, 25.5 mm in width, using a Protos cigarette making machine, using a standard tipping adhesive. The overwrapped tobacco roll is cut into 120 mm length segments.

A tobacco paper rod about 7.5 mm in diameter is formed from a medium embossed, 127 mm wide web of tobacco paper designated as P-144-GNA-CB available from Kimberly-Clark, e.g., using a rod forming apparatus such as that disclosed in U.S. Pat. No. 4,807,809. The rod is overwrapped with a KC paper P1487-184-2, about 25 mm wide, and cut into 80 mm length segments.

The tobacco roll and tobacco paper segments are cut into 40 mm and 20 mm segments respectively and are aligned in an alternating arrangement and overwrapped with a wrapper of KC 646 paper, 25.5 mm in width, using a center line hot melt adhesive 448-37A, RJR Packaging, and a seam adhesive, 448-195K hot melt, RJR Packaging. The combined tobacco roll/tobacco paper assembly is cut into a 2-up tobacco section 60 mm in length having a 40 mm tobacco roll center segment and 10 mm tobacco paper segment on each end of the tobacco roll segment.

Filter

A polypropylene filter rod about 7.5 mm in diameter is formed from a PP-100 mat, about 260 mm wide, available from Kimberly-Clark and overwrapped with a web of paper P1487-184-2, having a width of 25.5 mm, available from Kimberly-Clark, e.g., using the apparatus described in U.S. Pat. No. 4,807,809, and hot melt 448-195K seam adhesive. The overwrapped rod is cut into 80 mm length segments.

CIGARETTE ASSEMBLY

Fuel Substrate Section

A jacketed fuel rod is cut into fuel elements 12 mm in length. Two fuel elements are positioned on opposite sides of a substrate void tube section and aligned. These components are overwrapped with a wrapper about 26.5 mm in width and about 54 mm in length, comprising a paper/foil/paper laminate, comprising Ecusta 15456 paper/continuous cast 0.0005 inch thick aluminum foil/Ecusta 29492 paper, which are laminated to the foil using Airflex Adhesive 465. The laminate is adhered to the jacketed fuel and the substrate void tube assembly, by cold adhesive MT-8014, RJR Packaging, applied to the entire inner surface of the laminate. The wrapper overwraps the substrate tube and extends to within about 6 mm of the free end of each fuel element to form a 2-up fuel substrate section.

Tobacco Fuel Unit

A 2-up fuel/substrate section is cut at its midpoint and positioned on opposite sides of a 2-up tobacco section and aligned so that the void end of each fuel-substrate section is adjacent and abuts the tobacco paper plugs at each end of the 2-up tobacco section. The assembled components are overwrapped with Ecusta E30336 paper, about 70 mm in length and about 26 mm wide. The wrapper is adhered to the fuel substrate section and the tobacco section assembly with MT-8009 adhesive (RJR Packaging) to form a 2-up tobacco-fuel unit approximately 126 mm in length.

Cigarette

A 2-up tobacco-fuel unit is cut at its midpoint and positioned on opposite sides of a 2-up filter unit and aligned so that the tobacco roll end of a single tobacco-fuel unit is adjacent and abuts the 2-up filter. The assembled components are overwrapped with a tipping wrapper, RJR tipping code No. 1000011, approximately 50 mm in length and about 26 mm in width which extends approximately 5 mm over each of the junctures between the 2-up filter and each tobacco-fuel unit. The wrapper is adhered over its entire area to the assembled components with an adhesive MT-8009 (RJR Packaging) 100% coverage, to form a 2-up cigarette. The 2-up cigarette is cut at approximately its midpoint (i.e., the midpoint of the 2-up filter) to form a single cigarette.

EXAMPLE 9

Cigarette of FIG. 1

Fuel Element

A fuel element is prepared as in Example 1, from the following ingredients:

10 wt. percent ammonium alginate binder
5 wt. percent ball milled tobacco powder
8.4 wt. percent graphite powder
3 wt. percent calcium carbonate powder
1 wt. percent sodium carbonate powder
72.6 wt. percent powdered hardwood pulp carbon The length of the fuel element is about 12 mm and the diameter is about 7.5 mm. During processing, four or six equally spaced peripheral grooves having a depth of 1 mm and a width of 0.5 mm are formed on the surface of the fuel element, running from end to end. The fuel composition is mixed and continuously extruded to have the desired dimensions into the glass fiber layer/tobacco paper composite structure as described in Example 8.

Substrate

A continuous substrate rod about 7.5 mm in diameter and about 31 mm in length, is formed from a reconstituted tobacco cast sheet in cut filler form. The composition of the cast sheet material is as follows:

40–60 wt. percent glycerin

2–10 wt. percent ammonium alginate binder

15–35 wt. percent tobacco pulp (water extracted) in powder form

0–20 wt. percent inert filler (e.g., $CaCO_3$)

0–15 wt. percent flavors (tobacco extracts, etc.)

The cast sheet material is formed using conventional cast sheet equipment. The sheet material is cut into cut filler form at 25 to 32 cuts/in. and formed into rods using e.g., a Protos cigarette making machine. The substrate rod is overwrapped with a paper/aluminum foil laminate having a width of about 25.5 mm, the foil being cast aluminum, 0.0005 inches thick, and the paper is a Simpson Paper Company product known as RJR-002A paper. The laminate is formed with a commercial adhesive, Airflex 465. The laminated paper is formed into a tube (with the foil on the inside) by lap joining using a water based ethylene vinyl acetate adhesive. The overwrapped rod is cut into 31 mm segments in length, and charged with an aerosol former, e.g., glycerin, propylene glycol, and/or flavorants.

Reconstituted Tobacco Cut Filler Plug

A plug or rod of reconstituted tobacco in cut filler form, about 7.5 mm in diameter is formed from a cast sheet of reconstituted tobacco (see U.S. Pat. No. 5,159,942) which is then cut at 25 to 32 cuts/in. into cut filler. The cut filler rod is overwrapped with a 25.5 mm wide paper P1487-184-2 from Kimberly-Clark and cut into 20 mm lengths.

Filter Plug

A cellulose acetate tow filter rod about 7.5 mm in diameter is formed from a cellulose acetate tow overwrapped with a 25.5 mm wide web of paper Reference No. 29646, available from Ecusta, e.g., using a modified KDF-2 rod forming apparatus and an E-60 tow processing unit, available from Arjay Equipment Corporation. The overwrapped rod is cut into 20 mm length segments.

Assembly

The individual components are combined using standard cigarette tipping machines which have been modified to accommodate the non-standard lengths of the various components.

The fuel element segment and the substrate rod are aligned in an abutting end-to-end relationship. The two segments are attached together by a laminated wrapper which circumscribes and extends along the length of the substrate rod and a 6 mm length of the fuel element segment which is adjacent the substrate rod. The laminated wrapper includes an outer layer of Ecusta Ref. No. 99952 paper, a layer of adhesive available as LAM-5001 from RJR Packaging, a layer of 0.0005 inch thick aluminum foil, another layer of the LAM-5001 adhesive, and an inner layer of Ecusta Ref. No. 99951 paper. The lap adhesive is MT-8014 adhesive from RJR Packaging. The laminated wrapper is 37 mm in length and 24.4 mm in width.

The cut filler segment and the filter element segment are aligned in an abutting end-to-end relationship. The two segments are attached together by a paper available as Ref. No. 29646 from Ecusta. The paper circumscribes the length of each of the segments, the lap adhesive is designated as 448-195K by RJR Packaging, and the center line adhesive applied to the paper is designated as 448-37A by RJR Packaging. The paper wrapper is 40 mm in length and 25.5 mm in width.

The two combined segments are aligned in an abutting end-to-end relationship, with the fuel element segment at one end and the filter element segment at the other. The two combined segments are combined using a 48 mm long by 24,4 mm wide tipping material printed and treated with lip release agent, which material is a paper available as E-30336 from Ecusta. The tipping material circumscribes the length of the mouthend segment and the adjacent region of the substrate segment. The tipping material is maintained in place using an MT 8014 tipping adhesive.

The cigarette is smoked, and yields visible aerosol and tobacco flavor (i.e., volatilized tobacco components) on all puffs for about 10–12 puffs. The fuel element burns to about 6 mm back, i.e., to about the region where the foil lined tube overwraps the fuel element, and there the cigarette self-extinguishes.

EXAMPLE 10

Alternate Cigarette of FIG. 1

Fuel Element

A fuel element is prepared as in Example 1, from the following ingredients:

10 wt. percent ammonium alginate binder 5 wt. percent ball milled tobacco powder 8.4 wt. percent graphite powder 3 wt. percent calcium carbonate powder 1 wt. percent sodium carbonate powder 72.6 wt. percent powdered hardwood pulp carbon The length of the fuel element is about 12 mm and the diameter is about 7.5 mm. During processing, four or six equally spaced peripheral grooves having a depth of 1 mm and a width of 0.5 mm are formed on the surface of the fuel element, running from end to end. The fuel composition is mixed and continuously extruded to have the desired dimensions into the glass fiber layer/tobacco paper composite structure as described in Example 8.

Substrate

A cast sheet material is provided by casting an aqueous slurry of components from a headbox at a nominal thickness of about 30 mils onto a heated stainless steel belt. The cast slurry has a solids content of about 20 percent. The slurry is provided by dispersing in water about 20 parts of aqueous extracted tobacco pulp in the form of extracted stems and laminae, about 10 parts flue-cured tobacco laminae, and about 10 parts Burley tobacco laminae. As such, a slurry having about 1 part tobacco and about 8 parts water is provided. The resulting slurry is refined using a disc refiner, and transferred to a mixer. To the slurry, which includes about 40 parts tobacco, is added about 50 parts glycerine; about 2 parts of the type of tobacco extract described in Col. 11, lines 5–37 of U.S. Pat. No. 5,159,942 to Brinkley et al. diluted in water in an amount of about 8 parts extract and about 92 parts water; about 3 parts levulinic acid; about 1 part of a mixture of natural and/or artificial flavors (e.g., nut, cocoa, fructose, licorice, butter, artificial flue-cured tobacco or vanillin flavors); about 3 parts of a Burley tobacco extract which has been heat treated essentially in the manner set forth in U.S. Pat. No. 5,060,669 to White et al.; and about 5 parts of a mixture of glycerine, propylene glycol and a Burley tobacco extract available from Meer Corp. However, the selection and relative amounts of those components, such a flavors and tobacco extracts, can vary as desired to provide the desired organoleptic characteristics.

The resulting slurry is mixed to yield a consistent character. Then, about 5 parts ammonium alginate available as Amoloid HV from Kelco Division of Merck & Co., Inc. is added to the slurry. The resulting slurry is thoroughly mixed at ambient conditions using a Breddo Likwifier high shear propeller mixer. The slurry is cast onto a stainless steel belt heated at about 220° F. The case slurry is dried by heating at about 220° F. The dried cast slurry is diced and cut into cut filler size of about 25 cuts per inch. The cut filler is conditioned to yield a substrate material having a moisture content of about 15 percent and a thickness of about 6 mils.

The cast sheet substrate material is formed into rods using a rod forming apparatus available as Protos from Hauni-Werke Korber & Co. KG. The substrate rod includes a paper/aluminum foil laminate overwrap having a width of about 24.5 mm, the foil being cast aluminum, 0.0005 inches thick, and the paper is available as Ref. 29492 from Ecusta. The laminate is formed with a silicate adhesive, designated as No. 06-50-05-005 by RJR Packaging. The laminated paper is formed into a tube (with the foil on the inside) by lap joining using a CS1242 adhesive, available from RJR Packaging. The overwrapped rod is cut into 31 mm long segments. The 31 mm rod weighs about 400 mg.

Reconstituted Tobacco Cut Filler Plug

A roll of reconstituted tobacco in cut filler form, is formed from a reconstituted tobacco cut filler prepared essentially as described in Example 6 of U.S. Pat. No. 5,159,942 to Brinkley et al. The cut filler is provided at 25 cuts per inch. A rod incorporating the cut filler includes a 26.5 mm wide paper available as Ref. No. 456 from Ecusta. The rod is provided as a continuous rod using known cigarette making techniques (i.e., using a Protos cigarette rode making apparatus), and a lap adhesive available as CS1242 from RJR Packaging. The rod has a diameter of about 7.5 mm and is cut into segments, each of 20 mm in length. The tobacco cut filler in the 20 mm segment has a moisture content of about 12 percent, and weights about 220 mg.

Filter Plug

A cellulose acetate tow filter rod about 20 mm in length and about 7.5 mm in diameter is formed from a 10 denier per filament/35000 total denier cellulose acetate tow material obtained from Eastman Chemical Co., which is plasticized with up to about a six percent plasticizer level, using triacetin. The tow is overwrapped with a 25.5 mm wide web of paper Ref. No. 29646, available from Ecusta, e.g., using a modified KDF-2 rod forming apparatus and an E-60 tow processing unit, available from Arjay Equipment Corporation, and hot melt 448-195k seam adhesive from RJR Packaging. The overwrapped rod is cut into 20 mm length segments.

Assembly

The individual components are combined using standard cigarette tipping machines which have been modified to accommodate the non-standard lengths of the various components.

The fuel element segment and the substrate rod are aligned in an abutting end-to-end relationship. The two segments are attached together by a laminated wrapper which circumscribes and extends along the length of the substrate rod and a 6 mm length of the fuel element segment which is adjacent the substrate rod. The laminated wrapper includes an outer layer of Ecusta Ref. No. 99952 paper, a layer of adhesive available as LAM-5001 from RJR Packaging, a layer of 0.0005 inch thick aluminum foil, another layer of the LAM-5001 adhesive, and an inner layer of Ecusta Ref. No. 99951 paper. The lap adhesive is MT-8014 adhesive from RJR Packaging. The laminated wrapper is 37 mm in length and 24.4 mm in width.

The cut filler segment and the filter element segment are aligned in an abutting end-to-end relationship. The two segments are attached together by a paper available as Ref. No. 29646 from Ecusta. The paper circumscribes the length of each of the segments, the lap adhesive is designated as 448-195K by RJR Packaging, and the center line adhesive applied to the paper is designated as 448-37A by RJR Packaging. The paper wrapper is 40 mm in length and 25.5 mm in width.

The two combined segments are aligned in an abutting end-to-end relationship, with the fuel element segment at one end and the filter element segment at the other. The two combined segments are combined using a 48 mm long by 24.4 mm wide tipping material printed and treated with lip release agent, which material is a paper available as E-30336 from Ecusta. The tipping material circumscribes the length of the mouthend segment and the adjacent region of the substrate segment. The tipping material is maintained in place using an MT 8014 tipping adhesive.

The cigarette is smoked, and yields visible aerosol and tobacco flavor (i.e., volatilized tobacco components) on all puffs for about 10–12 puffs. The fuel element burns to about 6 mm back, i.e., to about the region where the foil lined tube overwraps the fuel element, and there the cigarette self-extinguishes.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A burnable composition suitable for making fuel elements for smoking articles, comprising at least fifty weight percent powdered elemental carbon, at least one weight percent binder, at least three weight percent powdered graphite, and at least one weight percent calcium carbonate, the amount of powdered graphite and calcium carbonate being sufficient to reduce the carbon monoxide generated during combustion of a fuel element prepared from the composition.

2. A burnable composition suitable for making fuel elements for smoking articles comprising at least sixty weight percent powdered elemental carbon at least five weight percent binder from about five to about twenty weight percent powdered graphite, from about two to about fifteen weight percent calcium carbonate, the amount of powdered graphite and calcium carbonate being sufficient to reduce the carbon monoxide generated during combustion of a fuel element prepared from the composition.

3. A burnable composition suitable for making fuel elements for smoking articles comprising at least seventy weight percent powdered elemental carbon, at least ten weight percent binder, at least eight weight percent powdered graphite, and at least three weight percent calcium carbonate, the amount of powdered graphite and calcium carbonate being sufficient to reduce the carbon monoxide generated during combustion of a fuel element prepared from the composition.

4. The fuel element composition of claim 1, 2, or 3, which further comprises up to about ten weight percent tobacco.

5. The fuel element composition of claim 1, 2, or 3, which further comprises up to about one weight percent sodium carbonate.

6. The fuel element composition of claim 1, 2, or 3, wherein the binder comprises an alginate binder.

7. The fuel element composition of claim 4, wherein the alginate binder comprises ammonium alginate.

8. The fuel element composition of claim 1, 2, or 3, wherein the powdered elemental carbon comprises hardwood pulp carbon which has an average particle size of about 12 μm.

9. The fuel element composition of claim 1, 2, or 3, wherein the powdered graphite has an average particle size of about 8 μm.

10. A cylindrical fuel element suitable for use in smoking articles, up to about 8 mm in diameter and up to about 20 mm in length, said fuel element being formed by extruding a fuel composition comprising at least fifty weight percent powdered hardwood pulp carbon, at least one weight percent binder, at least three weight percent powdered graphite, and at least one weight percent calcium carbonate, the amount of powdered graphite and calcium carbonate being sufficient to reduce the carbon monoxide generated during combustion of the fuel element.

11. A fuel element suitable for use in smoking articles, up to about 8 mm in diameter and up to about 20 mm in length, said fuel element being formed by extruding a fuel composition comprising at least sixty weight percent powdered elemental carbon, at least five weight percent binder, from about five to about twenty weight percent powdered graphite, and from about two to about fifteen weight percent calcium carbonate.

12. A cylindrical fuel element suitable for use in smoking articles, up to about 8 mm in diameter and up to about 20 mm in length, said fuel element being formed by extruding a fuel composition comprising at least seventy weight percent powdered hardwood pulp carbon, at least ten weight percent binder, at least eight weight percent powdered graphite, and at least three weight percent calcium carbonate, the amount of powdered graphite and calcium carbonate being sufficient to reduce the carbon monoxide generated during combustion of the fuel element.

13. The fuel element of claim 10, 11, or 12, in which the fuel composition further comprises up to about ten weight percent tobacco.

14. The fuel element of claim 10, 11, or 12, in which the fuel composition further comprises up to about one weight percent sodium carbonate.

15. The fuel element of claim 10, 11, or 12, wherein the binder in the fuel composition comprises an alginate binder.

16. The fuel element claim 15, wherein the alginate binder in the fuel composition comprises ammonium alginate.

17. The fuel element of claim 10, 11, or 12, wherein the powdered hardwood pulp carbon in the fuel composition has an average particle size of about 12 μm.

18. The fuel element of claim 10, 11, or 12, wherein the powdered graphite in the fuel composition has an average particle size of about 8 μm.

* * * * *